US007673983B2

(12) United States Patent
Coenen et al.

(10) Patent No.: US 7,673,983 B2
(45) Date of Patent: Mar. 9, 2010

(54) INKJET PRINTER

(75) Inventors: Jeroen J. G. Coenen, Venray (NL); Barry B. Goeree, Venlo (NL)

(73) Assignee: Océ-Technologies B.V., Venlo (NL)

( * ) Notice: Subject to any disclaimer, the term of this patent is extended or adjusted under 35 U.S.C. 154(b) by 353 days.

(21) Appl. No.: 11/220,615

(22) Filed: Sep. 8, 2005

(65) Prior Publication Data

US 2006/0050128 A1 Mar. 9, 2006

(30) Foreign Application Priority Data

Sep. 9, 2004 (NL) ..... 1027001

(51) Int. Cl.
*B41J 2/01* (2006.01)

(52) U.S. Cl. ..... 347/104; 347/101; 400/611; 271/226; 226/15

(58) Field of Classification Search ..... 347/104, 347/101, 16; 400/76, 611–613, 617; 271/225, 271/226; 226/15, 18
See application file for complete search history.

(56) References Cited

U.S. PATENT DOCUMENTS

| | | | | |
|---|---|---|---|---|
| 4,165,029 | A | 8/1979 | Mitchell | |
| 6,655,275 | B2 * | 12/2003 | Mugrauer | 101/228 |
| 2002/0130941 | A1 * | 9/2002 | Tanaami | 347/104 |
| 2003/0090557 | A1 * | 5/2003 | Lenkl | 347/104 |
| 2005/0024464 | A1 * | 2/2005 | Takagi | 347/104 |

FOREIGN PATENT DOCUMENTS

| | | | |
|---|---|---|---|
| EP | 0 666 180 | A2 | 8/1995 |
| EP | 1 219 454 | A2 | 7/2002 |
| JP | 1-198471 | A | 8/1989 |
| JP | 11-58899 | A | 3/1999 |
| JP | 2002-211796 | A | 7/2002 |
| JP | 2002-302313 | A | 10/2002 |

* cited by examiner

*Primary Examiner*—Matthew Luu
*Assistant Examiner*—Henok Legesse
(74) *Attorney, Agent, or Firm*—Birch, Stewart, Kolasch & Birch LLP

(57) ABSTRACT

An inkjet printer containing a print zone and an inkjet printhead for printing on a substrate in the print zone, a supply unit for storing and delivering the substrate for printing, and a transport unit for transporting the substrate from the supply unit to the print zone, in which printer the supply unit contains a number of substrate holders, each holding a roll on which a substrate web is wound, each substrate holder being operatively connected to a sensor for detecting the end of the web in the substrate holder corresponding to that sensor, wherein the transport unit includes a first transport means for engaging and transporting the substrate emerging from the supply unit, a downstream, second transport means for further transporting the substrate and positioning the same in the print zone, and a guide element rotatably disposed between the first transport means and the second transport means.

7 Claims, 4 Drawing Sheets

INKJET PRINTER

BACKGROUND OF THE INVENTION

The present invention relates to an inkjet printer for printing a substrate. The inkjet printer has a print zone and an inkjet printhead for printing the substrate in the print zone. In particular, the present invention relates to an inkjet printer for printing a substrate which is unwound from a roll.

The transport of a substrate unwound from a roll is more complex than the transport of sheets of a substrate. One reason for this is that the substrate has fewer degrees of freedom during the positioning thereof in the print zone. The trailing edge of the substrate is connected to the substrate that is still wound on the roll. There are therefore fewer possibilities of correcting faults occurring during the transport of the substrate or, for example, originating from inaccurate positioning of the roll in the printer supply unit. Another disadvantage of unwinding a substrate from a roll is the fact that the end of the roll cannot be predicted with high accuracy. It is therefore possible that at the beginning of printing of an image there appears to be sufficient substrate available to completely image the image on the substrate, but, in fact, during the printing it may be found that the amount of substrate still present on the roll is in fact insufficient to completely image the image on the substrate. It is known to stop printing as soon as it is found that a roll is completely unwound. However, since the distance between the roll and the print zone is often relatively considerable, a relatively large part of the substrate is not used in this case.

SUMMARY OF THE INVENTION

The object of the present invention is to provide an inkjet printer which obviates the disadvantages of the prior art. For this purpose a printer is provided which contains a dedicated transport unit for the transport of the substrate from a supply unit provided with a number of rolls of substrate, to the print zone, the transport unit also providing accurate positioning of the substrate. Since the transport unit is provided with two transport means for the substrate, it is possible to stop the substrate in this unit over a certain length. As a result it is an effective method for accurately positioning the substrate. In this way, substantially the entire length of the substrate situated on the roll can be effectively used. Also, a sensor is utilized so that the end of the web on the roll can be accurately determined. Using the current printer, however, there is no need immediately to stop printing. Since the transport unit includes two transport means and whenever the roll is empty the web can be stopped in a very defined manner, at least as long as the end of the web has not yet passed the first upstream transport means. The passing of the web can be accurately predicted if the distance between the sensor and the first transport means is known. Since the first transport means is also situated downstream of the supply unit, relatively close to the print zone, the requirement of accurate transport and positioning of the substrate can be fulfilled for practically the entire substrate length.

In one embodiment, the supply unit has a transit path for the substrate, the holders being arranged along the path in the downstream direction. This embodiment has the advantage that the same transit path can be used for the transport of the substrate from each of the holders. As a result, there are fewer variables in the transport of various substrates, so that the transport is more reproducible. This benefits the accuracy of the transport and positioning of the substrate.

In another embodiment, in which the first and second transport means are driven, the speed at which the second transport means is driven is greater than or equal to the speed at which the first transport means is driven if the substrate is engaged by both means. One important advantage of this embodiment is that the substrate is maintained in tension between the transport means. As a result, it is a simple matter to obtain accurate transport and positioning, and this contributes to a further improvement of the present invention.

In yet another embodiment, the transport unit is provided with a guide element to guide the substrate from the first to the second transport means. It has been found that as a result of the presence of the guide element, the incidence of creases, folds and other deformation of the substrate can be greatly reduced. This contributes to further increasing the accuracy of transport of the substrate through the printer and improvement of the positioning of the substrate in the print zone.

In a further embodiment, the guide element can be moved from a first to a second position such that the distance over which the substrate extends from the first transport means to the second transport means is greater when the guide element is in the first position. The advantage of this embodiment is that it is possible to obviate the problem that the mass inertia of the roll, particularly if it has been only slightly unwound or not unwound at all, is often greater than that of the transport means. As a result of this relatively high mass inertia, considerable power is required to combine a sudden acceleration of the transport means with the same acceleration of the roll, or at least an acceleration where the speed at which the substrate is unwound from the roll is equal to the speed at which the substrate is transported by the transport unit. The present embodiment can provide a solution to this problem by gradually moving the guide element to the second position on the sudden start up of the second most downstream transport means. As a result, the acceleration of the roll does not have to completely follow the acceleration of the transport means. Although a residue is, in fact, built up during the unwinding of the substrate, this can be compensated for by letting the unwinding take place longer than the transport by the second transport means.

In still a further embodiment of the present invention, each substrate holder is provided with its own sensor. This embodiment simplifies printer control because each holder has a dedicated sensor. In addition, it is now possible to dispose the sensors relatively close to each of the rolls at a distance which is also equal for each substrate holder. Here again, a simplification of the printer control is obtained.

In another embodiment, the printer has a control unit to determine, after a sensor detects the end of the web of the substrate, which image still to be printed can be completely imaged on the substrate without the end of the web passing the first transport means in the downstream direction. As indicated hereinbefore, for accurate positioning of the substrate in the print zone it is important for the substrate to be engaged by both the first and second transport means. In this embodiment it is possible to check if this is the case, for example on completion of the image currently being printed. If not, then the part of the image in which the substrate is no longer engaged by the first transport means, may possibly have print artefacts as a result of inaccurate positioning. It is then possible to decide whether to immediately stop the printing of that image and reprint the image on a following substrate. In this way no valuable ink is lost. If the image that is currently being printed can still be completed while both transport means engage the substrate, then it would already have been possible to check, if the next image for printing is already known and whether the following image can still be completely printed on condition that the substrate remains engaged by both transport means. If not, then it can be decided not to print the next image. In this manner optimum use of the substrate is possible without wasting ink.

BRIEF DESCRIPTION OF THE DRAWINGS

The present invention will now be explained in detail with reference to the following drawings, wherein.

DETAILED DESCRIPTION OF THE INVENTION

Figure 1:
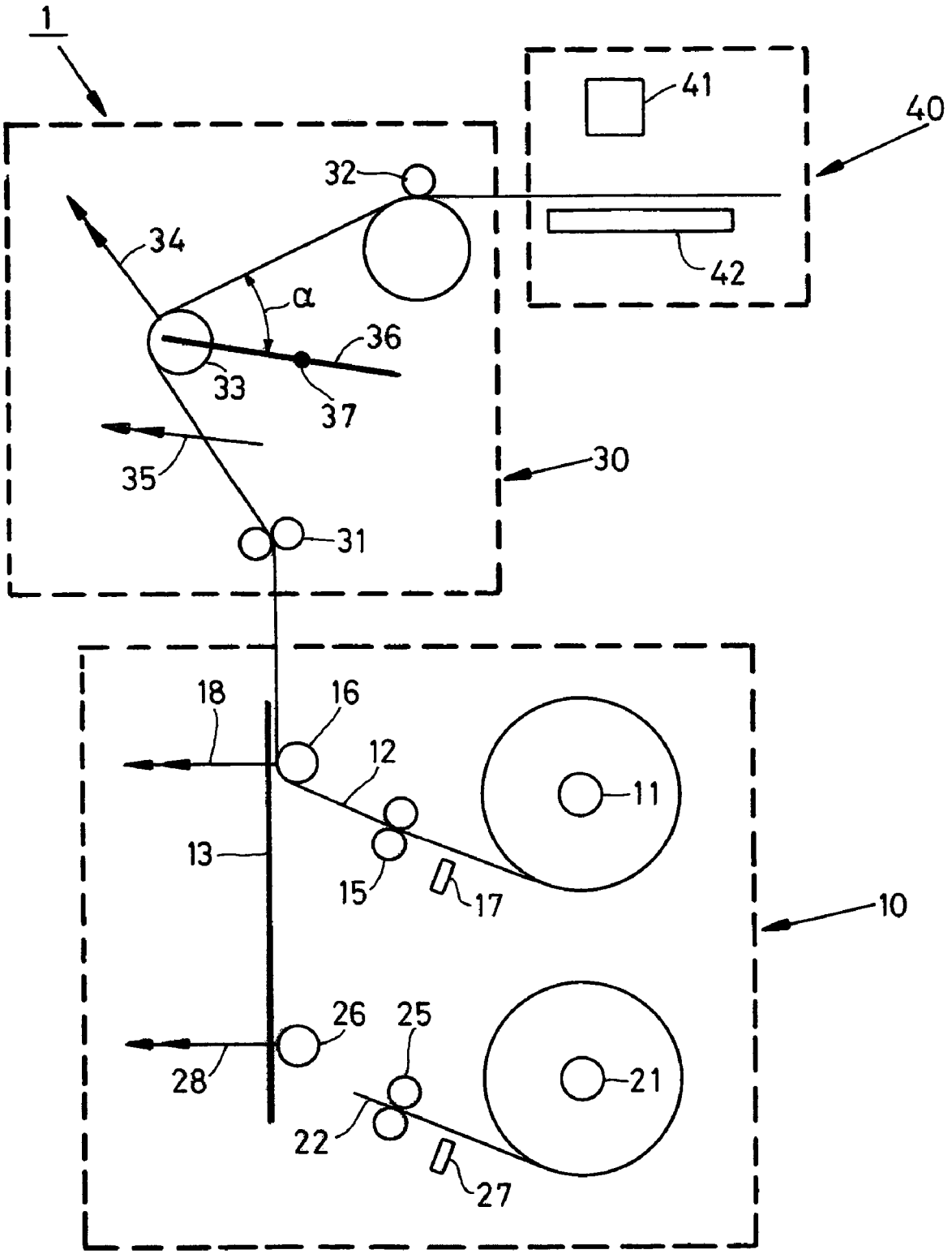
FIG. 1 is a diagram of a printer according to a specific embodiment of the present invention.

FIG. 1 is a diagram of a printer according to the present invention. This printer is provided with the supply unit 10, which serves for the storage and delivery of the substrate for printing. In addition, this printer includes a transport unit 30 which transports the substrate from the supply unit 10 to the print engine 40. Unit 30 also provides accurate positioning of the substrate in the print zone formed between the print surface 42 and the inkjet printhead 41. In this embodiment, print engine 40 is a conventional engine which includes printhead 41, which is constructed from a number of separate subheads, each of one of the colors: black, cyan, magenta and yellow. Printhead 41 has only a limited printing range so that it is necessary to print the image on the substrate in different sub-images. To this end, the substrate is transported in increments in each case so that a new part of the substrate can be printed in the print zone. In the example illustrated, the substrate 12 comes from a roll 11 from the supply unit 10. A web of the substrate is wound on this roll, the web having a length of 200 meters. To accommodate the roll in the printer, the supply unit is provided with a holder (not shown) to rotatably receive the roll. This holder consists of two parts mounted in side plates of the printer, which parts are brought into cooperative connection with the ends of the roll. In this embodiment, the supply unit is provided with a second holder to receive roll 21. Another substrate 22 is wound on this roll and can also be delivered by the supply unit for printing. For the transport of the substrate, roll 11 is operatively connected to transport means 15, which in this case includes a pair of rolls between which a transport nip is formed. More particularly, means 15 is a set of two shafts each extending in a direction substantially parallel to roll 11, on which a number of roll pairs are mounted, each forming a transport nip for the substrate. In an alternative embodiment, only one roll pair is mounted on the shafts substantially coinciding with the middle of the web 12.

Upstream of means 15 is a sensor 17, by means of which it is possible to determine whether there is still substrate on the roll situated in the associated holder. As soon as the roll is used up, the end of the web will pass the sensor, and this is detected by the sensor. For the transport of a substrate originating from roll 21, the supply holder is provided with transport means 25. Upstream of the transport means the supply holder is provided with sensor 27, which has the same action as sensor 17. The supply holder is provided with guide elements 16 and 26 to guide the substrates 12 and 22, respectively, to the transport unit 30. Downstream of these guide elements, there is a transit path 13. This transit path is used for both the transport of substrate 12 and the transport of substrate 22.

A substrate leaving the supply unit 10, in this example substrate 12, is engaged by transport means 31 of the transport unit 30. This transport means transports the substrate via guide element 33 on to the second transport means 32 of the transport unit 30. The transport means 32 engages the substrate, transports it to print engine 40 and ensures good positioning of the substrate in the print zone between the print surface 42 and the printhead 41. The transport means 31 and 32 extend substantially parallel to the rolls 11 and 21, and have a length such that the substrate can be engaged over substantially its entire width.

The guide elements 16 and 26 are, in this example, rollers extending parallel to the transport means 15 and 31; 25 and 31 respectively. They are substantially stationary rollers, i.e., they do not rotate about their axial axis. For the substrate 12 illustrated, this means that during transport, the substrate slides over element 16 and is at the same time fed in the direction of transport means 31. When this configuration is used it has been found that movement of the substrate at the guide element in a direction parallel to the direction in which the element extends is possible. In other words, the substrate can, in this way, make a lateral movement with respect to the direction in which the substrate is transported. The reason that a lateral movement of this kind is possible in this configuration is associated with the fact that the substrate makes a sliding movement with respect to the guide element. As a result, the required frictional force to set the substrate in motion initially with respect to the guide element is already overcome and practically no force is needed to move the substrate laterally over the guide element.

The guide elements are so disposed in the supply unit that they can each rotate, at least through a limited angle, about an axis substantially perpendicular to the direction in which the guide elements extend (i.e., the axial direction of the guide elements). In the Figure, the rotational axis 18 of element 16 is shown, and also rotational axis 28 of element 26. These rotational axes are perpendicular to the axes of the guide elements and intersect the center of said elements. As a result of this rotation combined with the possibility of moving the substrate laterally, the substrate has been found to have very good guidance from the supply unit 10 to nip 31 of the transport unit 30. As a result, despite the fact that the transport means 15 and 31; 25 and 31 respectively are not perfectly parallel, it is nevertheless possible to transport the substrate without any damage thereto.

Guide element 33 of transport unit 30, which element extends substantially parallel to the transport means 31 and 32, is also so disposed that it can rotate about an axis perpendicular to the axial direction of said element. This axis is shown by reference 34 and intersects the center of guide element 33. Since element 33, in this embodiment, is a co-rotating roller, the substrate is substantially stationary with respect to the surface of said guide element. As a result, lateral movement of the substrate at the guide element is made difficult. In order that such a movement can be made possible, element 33 is suspended so that it can rotate about axis 35, which axis 35 extends parallel to the bisector 36 of the angle $2\alpha$ over which the substrate is fed from transport means 31 to transport means 32. This axis 35 intersects the center of the substrate web at a distance of about 1 meter from the guide element itself. On the rotation of element 33 about this axis, the substrate makes a substantially lateral movement. The possibility of rotation of guide element 33 over the axes of 34 and 35 ensures flexible and accurate transport of the substrate from transport means 31 to transport means 32, even though the two means do not extend 100% parallel to one another.

Guide element 33 is movable from a first position in which it is situated in FIG. 1, to a second position in which the center of this element coincides with the location 37. In the first position, the distance over which substrate 12 extends between transport means 31 and transport means 32 is at a maximum. In the second position this distance is at a minimum. Use is made of this fact during the transport of the substrate to print engine 40. Since the substrate must, in each case, be moved over a relatively short distance, typically 5 to 10 cm, it is advantageous for this to occur relatively quickly. The mass inertia of roll 11, certainly when it is provided with the maximum quantity of substrate, is relatively high. For this reason, if the configuration of transport means and guide elements as illustrated were maintained, movement would take a considerable amount of time. To counteract this problem, transport means 31 is accelerated much more slowly than transport means 32. Nevertheless, in order to ensure adequate supply of substrate to transport means 32, the guide element 33 is moved in the direction of location 37. As a result, there is no lack of substrate at transport means 32 during its passage to print engine 40. If the passage by transport means 32 is stopped, the residue at transport means 31 is compensated for by allowing the transport means to continue rotating for some time. In these conditions, the element 33 is moved back to its first position. In this way, prior to the subsequent transport of a part of the substrate requiring printing with print engine 40, guide element 33 is in the same initial starting position. It has been found that in this way very accurate transport of the substrate is possible. As a result, the various sub-images can match up more satisfactorily and the number of print artefacts can be reduced.

The provision of accurate transport and particularly accurate positioning of the substrate in the print zone by the control of transport means 32, is related to the fact that the substrate is engaged by both transport means 31 and transport means 32. The position of the substrate is more satisfactorily defined as a result. Together with the rotational possibilities of guide element 33, very accurate transport and positioning of the substrate is obtained with the tension in the substrate not increasing to the extent where under normal circumstances, mechanical damage of the substrate would occur. An important additional advantage of this arrangement is that printing can still be continued on the substrate as long as the end of the web has not passed transport means 31. The instant at which this happens can easily be determined if the end of the web is detected by means of the sensor 17 or 27 operatively associated with the web. It is then a simple matter to determine what length of the substrate can still be fed on to the print engine 40 before the end of the web passes the means 31. In this way it is possible to determine whether the image printed at that instant can still be completely imaged on the substrate without the end of the web passing the first transport means. If so, that image will be completed. If not, then it is possible to choose to stop printing. However, when the end of the web passes means 31 the transport and the positioning of the substrate may be accompanied by more errors, and this may result in print artefacts. Too many artefacts can result in the image having to be reprinted. In order to save ink and substrate it is therefore better to stop printing.

If it is still possible to print the current image on the substrate (without the end of the web passing the means 31), it is then possible to determine whether the next image for printing can still be printed on the substrate (without the end of the web passing the means 31). If so, that image will be printed. If not, then it is better to print the following image on a new substrate, for example originating from roll 21.

Figure 2A:
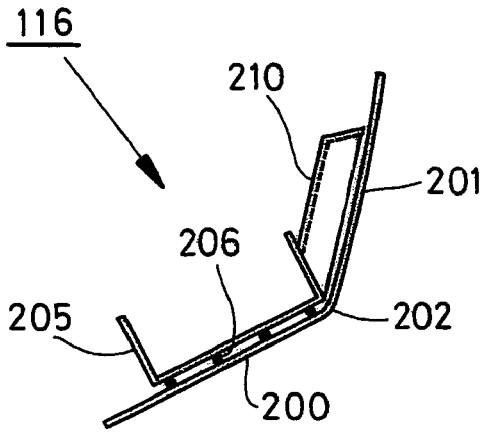
FIGS. 2*a* and 2*b* show a guide element that can be used as a guide for the substrate.
Figure 2B:
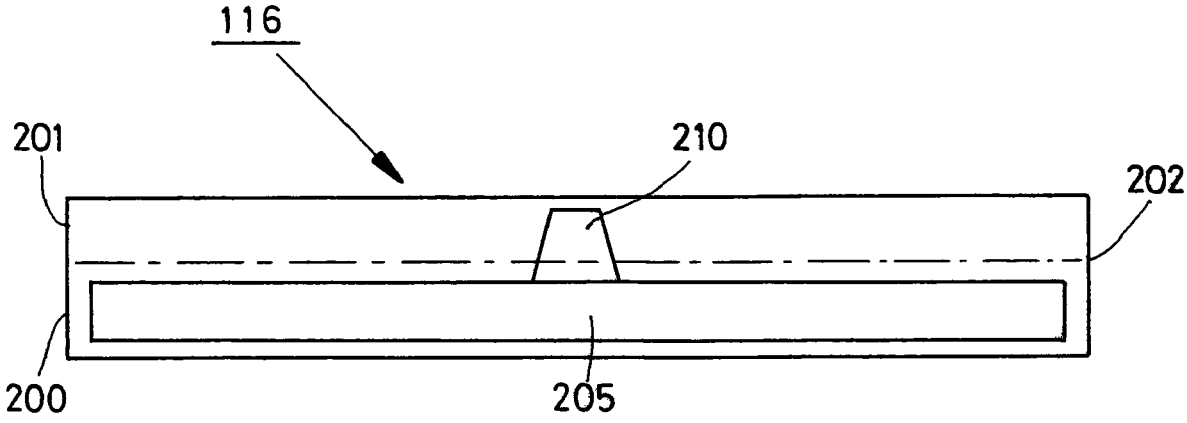

FIGS. 2*a* and 2*b* show a guide element 116 which can be used in a preferred embodiment as a guide for the substrate in the supply unit 10 (instead of the guide element 16 and/or 26). FIG. 2*a* is a side elevation of the guide element. This element comprises a bent plate having a part 200 situated upstream of the bend 202, and a part 201 which is situated downstream of the bend 202. Part 200 is connected by spot welds 206 to a rigid frame part 205. The frame part 205 is a U-profile extending over the length of element 116 and connected to the frame of the printer. Part 201 of the plate is much less restricted in its freedom of movement than part 200. Yoke 210 fixed on the U-shaped profile 205 provides a point of support for part 201, as seen in the front elevation of element 116, as shown in FIG. 2*b*. It will be clear from this front elevation that part 201 is substantially free. Since the plate is relatively thin, part 201 is torsionally weak and can at least partially rotate about the axis passing through the center of the yoke 210 and perpendicular to the longitudinal axis of element 116. In one embodiment, part 201 is provided with slots so that this part has less resistance to torsion.

If element 116 is placed in the supply unit to replace element 16, the free end of plate part 200 points towards the transport nip 15 and part 201 is substantially parallel to the transit path 13 of the supply unit. Element 116 is also stationary in the supply unit. As a result of the tension in the substrate, part 201 can be pulled against yoke 210. As a result, the ends particularly of part 201 can rotate about the axis passing through the center of the yoke, perpendicular to the direction in which element 116 extends. The advantages of this rotational possibility are described under FIG. 1.

Figure 3A:
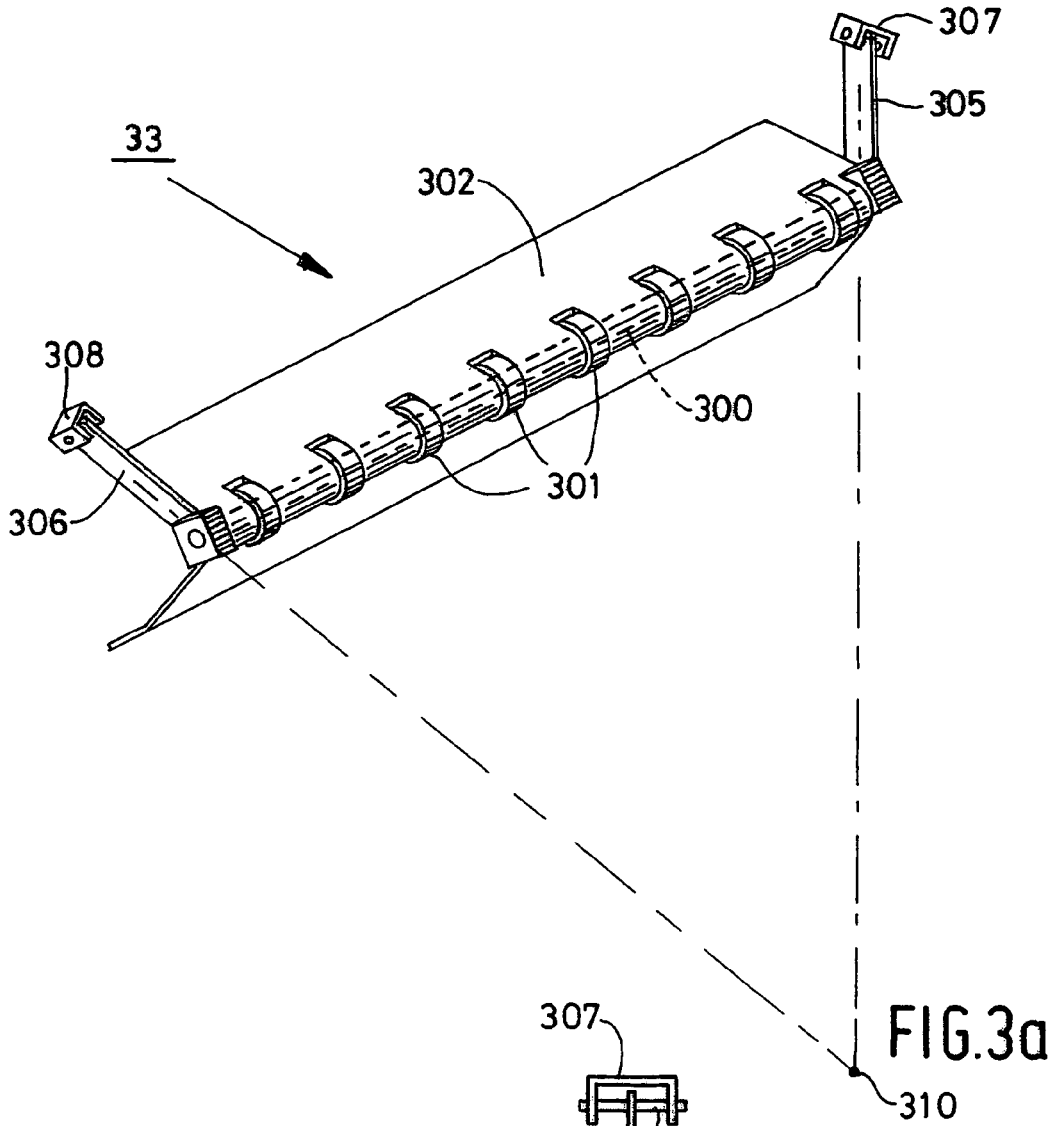
FIGS. 3*a*, 3*b* and 3*c* show another embodiment of the guide element.

FIG. 3*a* is a diagram of one embodiment of guide element 33. In this embodiment element 33 comprises a shaft 300 on which a series of transport wheels 301 are disposed. The substrate is guided over these wheels. Since the shaft is suspended to be freely rotatable, it can co-rotate with the substrate without any mutual difference in speeds. As a result, the frictional force accompanying the transport of the substrate at the roller is practically only dependent on the friction in the mounting of this roller.

Element 33 is provided with a guide plate 302 bent in the form of a V to assist in guiding the substrate. It should also be clear that the V-shape of the element 302 substantially coincides with the V-shape of the substrate as shown in FIG. 1. Shaft 300 is resiliently suspended by leaf springs 305 and 306 which are fixed to be freely rotatable on fixed frame parts 307 and 308 respectively. These leaf springs each form the same angle with the shaft in such a manner that the center lines of the leaf springs have a point of intersection 310 upstream of the roller. Rotational axis 35 intersects this point of intersection.

Figure 3B:
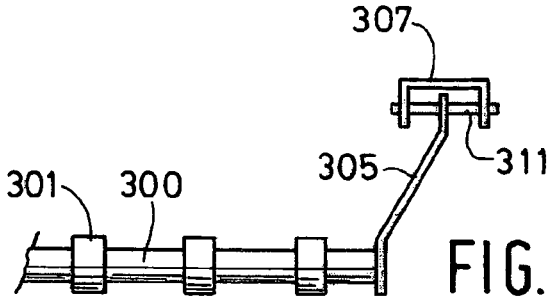

FIG. 3*b* shows the suspension of the shaft in greater detail. The leaf spring 305 is fixed on the end of shaft 300. Leaf spring 305 is, in turn, fixed on shaft 311 which is suspended to be freely rotatable in U-shaped frame part 307. By means of this suspension it is possible for roller 33 to rotate about the axes 34 and 35. Although the rotational possibility is finite, it appears to be sufficient to make possible accurate and reliable transport of the substrate between the nips 31 and 32.

Figure 3C:
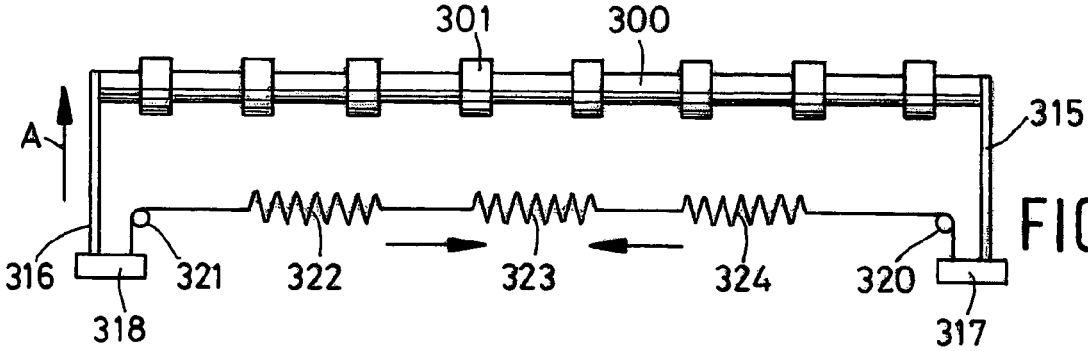

FIG. 3*c* diagrammatically shows the spring mechanism with which roller 33 is pushed in the indicated direction A. This direction A coincides with the direction extending from the above-mentioned second position that the element 33 can occupy (see FIG. 1, location 37) to the first position that the element occupies in FIG. 1. To this end, the shaft 300 is provided with side panels 315 and 316 which at their end remote from the shaft are provided with elements 317 and 318 respectively. The set of weak springs 322, 323 and 324 is fixed to these elements and freely guided over rotatable wheels 320 and 321. The springs are, to some extent, stretched so that they tend to move the ends of the set of springs to the center thereof, as indicated in FIG. 3*c*. As a result, the elements 317 and 318, and hence the shaft 300, are pushed in the indicated direction A.

Since the construction chosen results in a resistance to the displacement of the roller, a stiffness in respect of the movement of translation is introduced for the roller in principle. During movement of the roller to the second position, the resistance to this movement becomes increasingly greater. The advantage of this resistance is that the movement of the roller takes place more accurately and is more satisfactorily reproducible. By placing a number of long weak springs in series, this resistance remains sufficiently small but very effective.

Figure 4A:
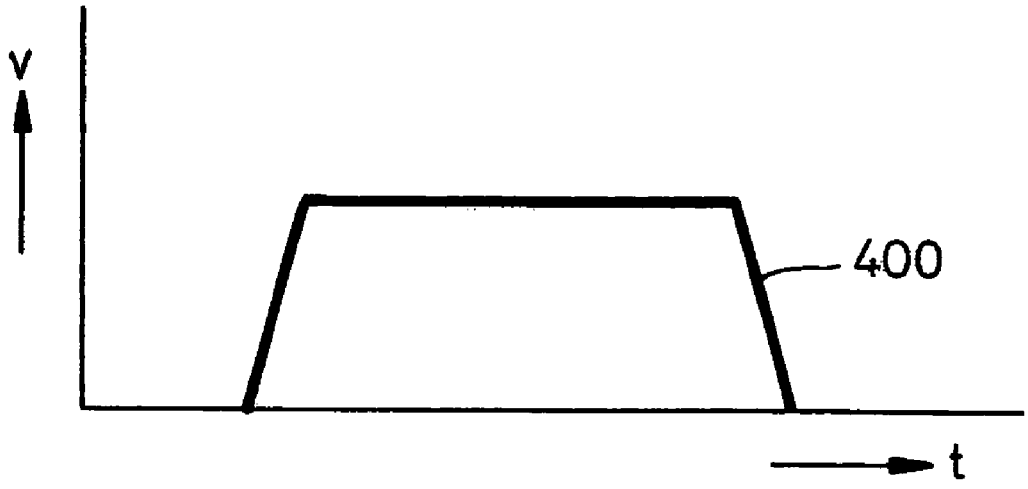
FIGS. 4*a* and 4*b* are diagrams showing the speeds at which the substrate is transported through the transport nips 32 (FIG. 4*a*) and 31 (FIG. 4*b*).
Figure 4B:
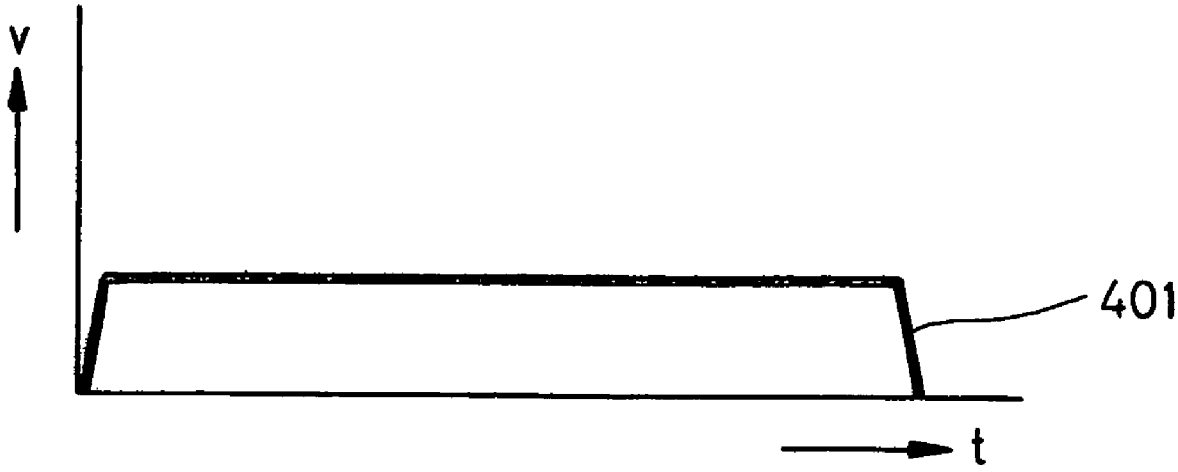

FIGS. 4*a* and 4*b* diagrammatically show the speed at which the substrate is transported through the transport nips 32 (FIG. 4*a*) and 31 (FIG. 4*b*) during the passage of part of the substrate so that a new strip thereof can be printed using the inkjet printhead 41.

Curve 400 in FIG. 4*a* shows what speed of passage is imposed on the substrate at the nip 32. A high speed of transit is generated relatively quickly and this is retained for some time and then rapidly drops to zero. Despite the high mass inertia of the roll on which the substrate is wound, this high acceleration can be obtained by moving roller 33 as indicated under FIG. 1.

Curve 401 in FIG. 4*b* shows the speed of transit imposed on the substrate at nip 31 for the transport of the same length of the substrate. It will be seen that this nip is driven before nip 32 so that the substrate is already partly unwound from roll 11 before nip 32 is driven. It may happen that movement of the roller 33 will enable the web to be tensioned between the means 31 and 32. The acceleration which is imparted by nip 31 is smaller than that of nip 32, and the maximum speed of transit that this nip provides is lower. However, the substrate is passed through for a longer time so that ultimately the same length of the substrate passes the nip 31.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer which comprises a print zone and an inkjet printhead for printing on a substrate in the print zone, a supply unit for storing and delivering the substrate for printing, and a transport unit for transporting the substrate from the supply unit to the print zone, the supply unit containing at least one substrate holder, each holder containing a roll on which a substrate web is wound, the substrate holder being operatively connected to a sensor for detecting the end of the web in the substrate holder corresponding to the sensor, the transport unit having a first transport means for engaging and transporting the substrate emerging from the supply unit and a downstream, second transport means for further transporting and positioning the substrate in the print zone, and a guide element rotatably mounted and positioned substantially perpendicular to the transport direction for guiding the substrate from the first to the second transport means said guide element having three axes of rotation with the resulting control of the lateral position of the substrate for ensuring accurate and flexible guiding of the substrate from the first to the second transport means, and said guide element being rotatable about an axis corresponding to the center line of the shaft of the guide element, about an axis perpendicular to the axial direction of the guide element whereby the guide element makes a pivotable movement in a direction perpendicular to the transport direction of the substrate, and about an axis which extends parallel to a bisector of the angle over which the substrate is conveyed from the first transport means to the second transport means, and wherein the printer is provided with a control unit to determine, after a sensor detects the end of the web of the substrate, which image still to be printed can be completely imaged on the substrate without the end of the web passing the first transport means in the downstream direction.

2. The printer according to claim 1, wherein the supply unit has a transit path for the substrate with the substrate holder being arranged along the transit path in the downstream direction.

3. The printer according to claim 1, wherein the supply unit contains a plurality of substrate holders.

4. The printer according to claim 1, wherein means are provided for driving the first and second transport means, the speed at which the second transport means is driven being equal to or higher than the speed at which the first transport means is driven when the substrate is engaged by both transport means.

5. The printer according to claim 1, wherein the guide element can be moved from a first position to a second position such that the distance over which the substrate extends from the first transport means to the second transport means is greater when the guide element is in the first position.

6. The inkjet printer of claim 1, wherein the guide element is rotatably mounted on a shaft which is resiliently suspended by leaf springs which are fixed to be freely rotatable on fixed frame elements, said leaf springs being configured together to form the same angle with the shaft in such a manner that center lines of the leaf springs intersect upstream of the guide element.

7. The printer according to claim 3, wherein each substrate holder is provided with its own sensor.

* * * * *